US009070982B2

(12) United States Patent
Carpentier et al.

(10) Patent No.: US 9,070,982 B2
(45) Date of Patent: Jun. 30, 2015

(54) INTEGRATED MILLIMETER WAVE TRANSCEIVER

(75) Inventors: Jean-François Carpentier, Grenoble (FR); Laurent Dussopt, Grenoble (FR); Henri Sibuet, La Buisse (FR)

(73) Assignees: STMicroelectronics (Crolles 2) SAS, Crolles (FR); COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 381 days.

(21) Appl. No.: 13/490,334

(22) Filed: Jun. 6, 2012

(65) Prior Publication Data

US 2013/0027274 A1 Jan. 31, 2013

Related U.S. Application Data

(63) Continuation of application No. 13/332,015, filed on Dec. 20, 2011, now abandoned.

(30) Foreign Application Priority Data

Dec. 20, 2010 (FR) ..... 10/60849

(51) Int. Cl.
*H01Q 1/40* (2006.01)
*H01Q 13/18* (2006.01)
*H01Q 23/00* (2006.01)

(52) U.S. Cl.
CPC ..... *H01Q 13/18* (2013.01); *H01Q 23/00* (2013.01)

(58) Field of Classification Search
CPC ..... H01Q 1/40
USPC ..... 343/873, 853, 851
See application file for complete search history.

(56) References Cited

U.S. PATENT DOCUMENTS

| | | | | |
|---|---|---|---|---|
| 5,128,689 | A | 7/1992 | Wong et al. | |
| 5,657,024 | A | 8/1997 | Shingyoji et al. | |
| 5,666,128 | A * | 9/1997 | Murray et al. | 343/878 |
| 6,608,259 | B1 | 8/2003 | Norskov | |

(Continued)

FOREIGN PATENT DOCUMENTS

| | | | |
|---|---|---|---|
| JP | 2001028413 | A | 1/2001 |
| KR | 100780328 | B1 | 11/2007 |
| WO | 2005/093902 | A1 | 10/2005 |

OTHER PUBLICATIONS

Lee et al., "A Low-Power Fully Integrated 60Ghz Transceiver System with 00K Modulation and On-Board Antenna Assembly," 2009 IEEE International Solid-State Circuits Conference (ISSCC 2009), Session 18 / Ranging and Gb/s Communication, 18.6, pp. 316-318.

*Primary Examiner* — Huedung Mancuso
(74) *Attorney, Agent, or Firm* — Seed IP Law Group PLLC

(57) ABSTRACT

A millimeter wave transceiver including a plate forming an interposer having its upper surface supporting an interconnection network and having its lower surface intended to be assembled on an electronic device; at least one integrated circuit chip assembled on the upper surface of the interposer; at least one antenna including at least one track formed on the upper surface of the interposer; and at least one block attached under the plate and including in front of each antenna a cavity having a metalized bottom, the distance between each antenna and the bottom being on the order of one quarter of the wavelength, taking into account the dielectric constants of the interposed materials.

19 Claims, 3 Drawing Sheets

(56) References Cited

U.S. PATENT DOCUMENTS

| | | | | |
|---|---|---|---|---|
| 7,545,323 | B2 * | 6/2009 | Kalian et al. | 342/372 |
| 7,551,136 | B1 * | 6/2009 | Kalian et al. | 342/368 |
| 2005/0134507 | A1 | 6/2005 | Dishongh et al. | |
| 2008/0029886 | A1 | 2/2008 | Cotte et al. | |
| 2008/0048307 | A1 | 2/2008 | Nakatani et al. | |
| 2008/0158091 | A1 * | 7/2008 | Imaoka et al. | 343/851 |
| 2010/0007571 | A1 | 1/2010 | Riedel | |
| 2010/0219523 | A1 | 9/2010 | Chow et al. | |
| 2010/0225539 | A1 | 9/2010 | Margomenos et al. | |
| 2010/0289713 | A1 | 11/2010 | Taura | |

* cited by examiner

INTEGRATED MILLIMETER WAVE TRANSCEIVER

BACKGROUND

1. Technical Field

The present disclosure relates to transceiver systems capable of operating with millimeter waves and capable of issuing and receiving signals from devices arranged at distances greater than one meter, for example, on the order of 10 meters.

2. Description of the Related Art

In a system operating with millimeter waves, for example, at a frequency on the order of 60 GHz, the available powers are such that antenna arrays providing directional beams, often called phased arrays, are employed. In such arrays, each antenna transmits a signal which is phase-shifted with respect to that of the other antennas or is capable of receiving a signal which is phase-shifted with respect to that of the other antennas.

At 60 GHz, the wavelength in air is 5 mm. The largest dimension of antennas currently is on the order of half the wavelength, that is, 2.5 mm, and each antenna is separated from the surrounding antennas by a distance at least of the same order of magnitude.

Accordingly, it is in practice impossible to arrange the antenna array on the integrated circuit chip which contains the electronic circuits capable of providing, receiving, processing, and amplifying the high-frequency signals of the antennas. This would indeed result in prohibitive chip dimensions.

Known devices have often used antennas assembled on individual substrates inserted in a ceramic block, also intended to receive the integrated processing circuit. This makes the system relatively complex, all the more as the track lengths between each of the elements should be made the shortest possible to avoid stray radiations and interferences. Further, some of these systems force the card manufacturer to provide relatively complicated devices to reprocess the transmitted/received signals.

BRIEF SUMMARY

One embodiment of the disclosure is a system forming a single assembly comprising a circuit of high-frequency signal transmission-reception, and advantageously processing and amplification, and an array of transceiver antennas of minimum bulk.

One embodiment of the disclosure is to a system which is particularly adapted to being simply assembled on a printed circuit board.

One embodiment of the disclosure is a millimeter wave transceiver comprising: a plate forming an interposer having its upper surface supporting an interconnection network and having its lower surface intended to be assembled on an electronic device; at least one integrated circuit chip assembled on the upper surface of the interposer; at least one antenna comprising at least one track formed on the upper surface of the interposer; and at least one block attached under the plate and comprising in front of each antenna a cavity having a metalized bottom, the distance between each antenna and the bottom being on the order of one quarter of the wavelength, taking into account the dielectric constants of the interposed materials.

According to an embodiment, each of the antennas is totally or partly surrounded with a peripheral conductive track on the upper surface of the interposer, said track being connected to a network of through vias in contact or in quasi-contact with a metallization of the block.

According to an embodiment, the interposer is a silicon plate.

According to an embodiment, the upper surface is coated with an encapsulation resin.

According to an embodiment, the bottom and the peripheral conductive tracks are grounded.

According to an embodiment, the electronic device is a printed circuit board and the interposer is assembled on the board by bumps.

The foregoing and other features and advantages will be discussed in detail in the following non-limiting description of specific embodiments in connection with the accompanying drawings.

BRIEF DESCRIPTION OF THE SEVERAL VIEWS OF THE DRAWINGS

For clarity, the same elements have been designated with the same reference numerals in the different drawings and, further, as usual in the representation of integrated circuits, the various drawings are not to scale.

DETAILED DESCRIPTION

Figure 1:
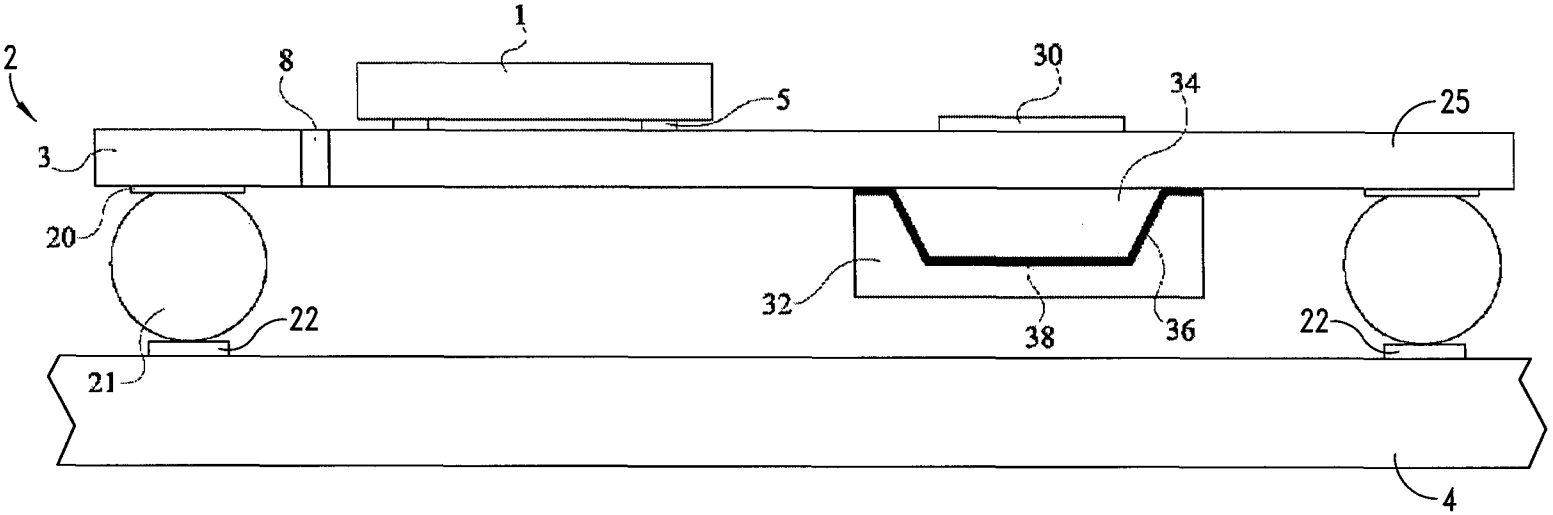
FIG. 1 is a simplified cross-section view of a portion of an integrated transceiver system.

FIG. 1 is a very simplified cross-section view of an electronic device that includes a millimeter wave transceiver assembly 2 mounted on a printed circuit board 4. This assembly 2 comprises an integrated circuit chip 1 comprising various circuits for processing and amplifying high-frequency signals transmitted/received by antennas. On its lower side, the chip comprises an assembly of conductive and insulating layers, not shown, forming interconnection levels for the interconnection of the various chip components and the connection of these components to the outside.

Chip 1 is assembled on an interposer plate 3. This plate is topped with an interconnection network, not shown, comprising insulating layers, metal tracks on one or more levels, and vias. The assembly of chip 1 on interposer plate 3 is for example performed via conductive pillars 5, for example, made of copper.

In interposer 3, which for example is a silicon or glass plate, are formed insulated conductive through vias 8, a single one being shown, which are connected by the interconnection network to pads of chip 1. Metallizations 20, actually comprising, in practice, an assembly of metallizations to which (welded) conductive bumps 21 are attached, are formed on the lower side of the interposer plate. The conductive bumps 21 are attached to conductive pads 22 on a surface of the printed circuit board 4 in order to electrically couple the transceiver 2 to other circuits of the electronic device that are also mounted on the printed circuit board (not shown).

On the upper surface of interposer plate 3 are arranged antennas 30 formed of conductive tracks according to any antenna configuration suitable for the transmission and/or the reception of millimeter waves. Although a single antenna appears in the cross-section view of FIG. 1, it should be understood that there is a number of transmitting antennas and a number of receiving antennas which are connected by metallization levels, not shown, to appropriate terminals of chip 1 so that, in operation, each of these antennas is excited with a given phase-shift with respect to the other antennas.

An antenna 30 transmits, when excited, a high-frequency radiation, upwards as well as downwards. To improve the efficiency of the antenna and avoid stray radiations, the beam that this antenna sends downwards is sent back up. To achieve this, it is provided to arrange under antenna assemblies a block 32 comprising, directly under each antenna 30, a recess 34 coated with a metallization 36 having its bottom 38 forming a reflector. This reflector should be arranged at a vertical distance on the order of $\lambda/4$ from the antenna, $\lambda$, being the wavelength of the radiation. Of course, distance $\lambda/4$ should take into account the fact that the space between the antenna and the reflector comprises the thickness of the interposer plate 3, having a dielectric constant on the order of 12 if this interposer is made of silicon, and an air gap having a dielectric constant equal to 1, as well as possibly, a small insulator thickness between the antenna and the interposer. The thickness of the interposer plate is accurately known and the height of the recess in block 32 is also accurately determined.

As a numerical example, for a silicon interposer having a 120-μm thickness, the recess height will be 400 μm for a 60-GHz frequency, which results in an operating bandwidth on the order of 13 GHz.

Figure 2:
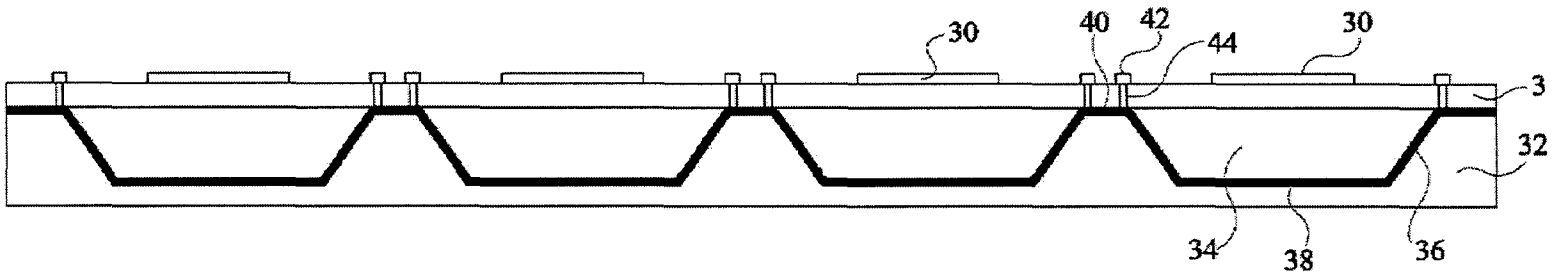
FIG. 2 is a simplified cross-section view of an antenna portion of the transceiver system of FIG. 1.

FIG. 2 is a cross-section view of a portion of the assembly described herein comprising, on the upper side of interposer plate 3, antennas 30. A portion of a block 32 comprising several recesses has been shown. Block 32 is advantageously made of silicon and may be manufactured and attached by any known means to the lower surface of the interposer. Especially, technologies developed in the field of the manufacturing and assembly of MEMS (Micro-Electro-Mechanical-System) may be used. Preferably, the upper surface of block 32 in contact with interposer 3 is also coated with a metal layer 40 and the periphery of each antenna region is surrounded with a conductive track 42. Surrounding track 42 is connected by a network of conductive vias 44 to lower layer 40 (these vias are effectively in contact with layer 40 or are separated therefrom by a small distance as compared with the wavelength of the antenna radiation—this is called a quasi-contact). Thus, the downward radiation of antenna 30 reflects on reflector 38 but cannot diverge to create parasitic waves, especially in the interposer, due to the tight network of vias which surrounds the area separating the antenna from its reflector, forming a Faraday cage. Thus, any influence of an antenna 30 on the neighboring antennas and/or on integrated circuit chip 1 is avoided. A double network of tracks and vias has been shown in FIG. 2. A simple surrounding line 42 and a single network of vias 44 may also be used.

Figure 3:
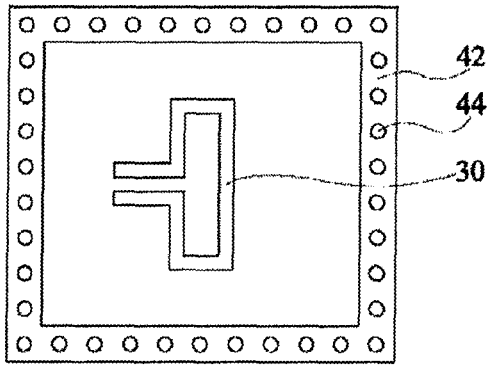
FIG. 3 is a top view of an antenna element.

FIG. 3 is a top view of an antenna 30 surrounded with a track 42 connected by regularly distributed vias 44 to the upper surface metallization of block 32. Preferably, the surrounding track and metallizations 36, 38, 40 are grounded. Bumps 21 shown in FIG. 1 may be attached to interposer 3 after installation of block(s) 32. Block(s) 32 will have a thickness smaller than the bump diameter so that, when the system is arranged on a printed circuit board, there is no contact between these blocks and the printed circuit board.

Thus, chip 1, interposer plate 3, and bumps 21 form an assembly ready to be delivered by a manufacturer to a system assembler which assembles the above-mentioned assembly on another electronic device, for example, a printed circuit board on which metallizations capable of receiving bumps 21 are formed. The upper surface of this assembly is preferably encapsulated in an insulating body 25, for example, made of resin, to protect the product and possibly mark it (FIG. 1).

According to an advantage of the above-described system, the connections between the chip and the antennas may have well-determined minimum lengths.

Figure 4:
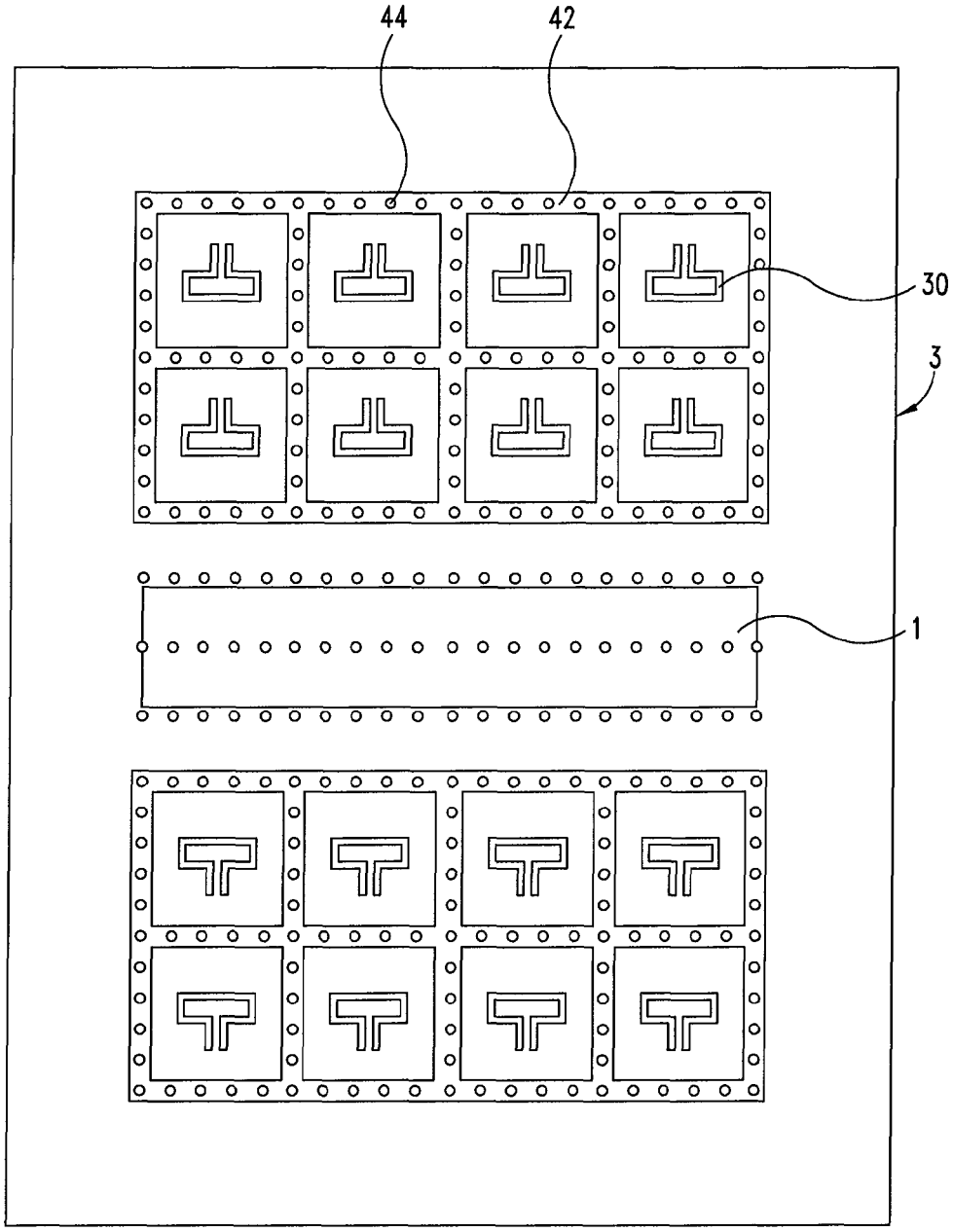
FIG. 4 is a general top view of a transceiver system.

FIG. 4 is a general view of the system. It shows, in its central portion, integrated circuit 1 and connection pads of this circuit intended to be connected to the above-mentioned through vias 8. Antennas 30, by the number of 16 in the shown example, are arranged on either side of integrated circuit 1. As indicated, each of these antennas is surrounded with a conductive track 42 periodically connected by vias 44 to a corresponding conductive track formed under interposer 3. A block 32 may be provided under each of the antenna assemblies or a single block may be provided under the entire interposer plate.

This top view shows that each of the antennas is insulated from the neighboring ones and from the environment by the via network.

Of course, the present disclosure is likely to have various alterations which will occur to those skilled in the art, especially as concerns the shape of the antennas. Further, the various metallization levels formed on the interposer, and especially the metallizations intended to connect the integrated circuit to each of the antennas, have not been described in detail. Indeed, these are common layouts. What matters is for all the metallizations to be arranged on a same surface of an interposer and thus to have a minimum dimension.

Such alterations, modifications, and improvements are intended to be part of this disclosure, and are intended to be within the spirit and the scope of the present disclosure. Accordingly, the foregoing description is by way of example only and is not intended to be limiting.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A millimeter wave transceiver comprising:

an interposer plate having an upper surface and a lower surface;

an integrated circuit chip positioned on the upper surface of the interposer;

an antenna that includes a track formed on the upper surface of the interposer, the antenna being configured to transmit a millimeter wave signal from the integrated circuit chip;

a block attached to the lower surface of the interposer plate and including a cavity directly under the antenna; and a metal layer covering a bottom of the cavity, the metal layer being separated from the antenna by a distance on the order of one quarter of a wavelength of the signal and being configured to reflect the signal back towards the antenna.

2. The transceiver of claim 1, further comprising:

a peripheral conductive track on the upper surface of the interposer and partly or totally laterally surrounding the antenna; and a network of through vias coupled to the track and in contact or in quasi-contact with the metal layer.

3. The transceiver of claim 2, wherein the metal layer and the peripheral conductive track are grounded.

4. The transceiver of claim 1, wherein the interposer plate is a silicon plate.

5. The transceiver of claim 1, further comprising an encapsulation resin covering the integrated circuit chip, interposer plate, and antenna.

6. The transceiver of claim 1, further comprising conductive bumps coupled to the lower surface of the interposer plate, the block having a thickness less than a thickness of the conductive bumps such that the conductive bumps extend further from the lower surface of the interposer plate compared to the block.

7. An electronic device, comprising:

a printed circuit board; and a millimeter wave transceiver coupled to the printed circuit board and including:

an interposer plate having an upper surface and a lower surface;

an integrated circuit chip assembled on the upper surface of the interposer;

an antenna that includes a track formed on the upper surface of the interposer, the antenna being configured to transmit a millimeter wave signal from the integrated circuit chip;

a block attached the lower surface of the interposer plate and including a cavity directly under the antenna; and a metal layer covering a bottom of the cavity, the metal layer being separated from the antenna by a distance on the order of one quarter of a wavelength of the signal and being configured to reflect the signal back towards the antenna.

8. The electronic device of claim 7, wherein the transceiver includes:

a peripheral conductive track on the upper surface of the interposer and partly or totally laterally surrounding the antenna; and a network of through vias coupled to the track and in contact or in quasi-contact with the metal layer.

9. The electronic device of claim 8, wherein the metal layer and the peripheral conductive track are grounded.

10. The electronic device of claim 7, wherein the interposer plate is a silicon plate.

11. The electronic device of claim 7, wherein the transceiver includes an encapsulation resin covering the integrated circuit chip, interposer plate, and antenna.

12. The electronic device of claim 7, further comprising conductive bumps coupled between the lower surface of the interposer plate and the printed circuit board, the block having a thickness less than a thickness of the conductive bumps such that a lower surface of the block is spaced apart from the surface of the printed circuit board.

13. A millimeter wave transceiver comprising:

an interposer plate having an upper surface and a lower surface;

an integrated circuit chip positioned on the upper surface of the interposer;

a plurality of antennas respectively including a plurality of tracks formed on the upper surface of the interposer, the antennas being configured to transmit a millimeter wave signal from the integrated circuit chip;

a block attached to the lower surface of the interposer plate and including a plurality of cavities, each cavity being directly under a corresponding one of the antennas and including a bottom; and a plurality of metal portions respectively covering the bottoms of the cavities, the metal portions being separated from the antennas by a distance on the order of one quarter of a wavelength of the signal and being configured to reflect the signal back towards the antennas.

14. The transceiver of claim 13, wherein the metal portions are parts of a signal, continuous metal layer.

15. The transceiver of claim 14, further comprising:

a conductive track network on the upper surface of the interposer, the conductive track network laterally isolating the antennas from each other; and a network of through vias coupled to the track network and in contact or in quasi-contact with the metal layer.

16. The transceiver of claim 15, wherein the metal layer and the conductive track network are grounded.

17. The transceiver of claim 13, wherein the interposer plate is a silicon plate.

18. The transceiver of claim 13, further comprising an encapsulation resin covering the integrated circuit chip, interposer plate, and antennas.

19. The transceiver of claim 13, further comprising conductive bumps coupled to the lower surface of the interposer plate, the block having a thickness less than a thickness of the conductive bumps such that the conductive bumps extend further from the lower surface of the interposer plate compared to the block.

* * * * *